US007540234B1

(12) United States Patent
Fox

(10) Patent No.: US 7,540,234 B1
(45) Date of Patent: Jun. 2, 2009

(54) WASTE BALING MACHINE

(75) Inventor: Anthony Fox, Bloomington, MN (US)

(73) Assignee: Buhl Hardwick LLC, Albertville, MN (US)

( * ) Notice: Subject to any disclaimer, the term of this patent is extended or adjusted under 35 U.S.C. 154(b) by 0 days.

(21) Appl. No.: 12/018,369

(22) Filed: Jan. 23, 2008

(51) Int. Cl.
*B65B 13/20* (2006.01)

(52) U.S. Cl. ..... 100/3; 100/215; 100/226; 100/240; 100/254

(58) Field of Classification Search ..... 100/3, 100/215, 225, 226, 229 A, 245, 254, 269.01, 100/34, 240; 49/360, 445, 453, 463; 312/257.1, 312/263, 264, 350, 351; 220/4.31, 4.21, 220/4.24, 677, 682, 689
See application file for complete search history.

(56) References Cited

U.S. PATENT DOCUMENTS 757,178 A * 4/1904 Cross ..... 49/102
987,206 A * 3/1911 Wilson ..... 220/4.31
3,288,325 A * 11/1966 Fulton ..... 141/390
3,955,492 A * 5/1976 Topolay ..... 100/215
4,007,677 A 2/1977 Fox
4,041,856 A 8/1977 Fox
4,944,220 A 7/1990 Fox
RE33,527 E 1/1991 Fox
5,012,732 A 5/1991 Fox
5,062,358 A 11/1991 Fox
5,517,907 A 5/1996 Fox
5,645,332 A * 7/1997 Snoke et al. ..... 312/257.1
6,167,803 B1 * 1/2001 Schwelling ..... 100/255
6,925,928 B2 8/2005 Fox
6,931,987 B2 * 8/2005 Pax et al. ..... 100/349
7,237,477 B1 7/2007 Fox

* cited by examiner

*Primary Examiner*—Jimmy T Nguyen
(74) *Attorney, Agent, or Firm*—James J. Paige; Nikolai & Mersereau, P.A.

(57) ABSTRACT

In some embodiments, a compactor for a restaurant facility may include one or more of the following features: (a) a base, a first side panel, and a second side panel, (b) a first door for access to the compactor to place trash into the compactor for compacting, (c) a second door for access to the compactor to remove compacted trash, (d) at least one door operably coupled to a counterbalance weight to provide easy movement of the at least one door to move along a track, and (e) at least one continuous channel beginning in an upper portion of a back wall and traversing to a front of the base, the channel having a curved portion transitioning from the back wall to the bottom wall.

5 Claims, 5 Drawing Sheets

WASTE BALING MACHINE

FIELD OF THE INVENTION

Embodiments of the present invention relate generally to waste management. Particularly, embodiments of the present invention relate to improved methods of handling waste products. More particularly, embodiments of the present invention relate to baling recyclables and trash.

BACKGROUND

A baler is a piece of machinery used to compress material into bales and bind the bales. There are several different types of balers commonly used. Balers are also used in the material recycling facilities, primarily for baling plastic, paper, or cardboard for transport to a recycling facility.

A baler is a piece of machinery used to compress material. Compressing takes up less space when stored, or when transported via truck or train to a recycling facility. A baler is just one step of the recycling process. They can also be used to compact other forms of waste, such as trash or even large boxes.

Balers can be portable or stationary. Older machines tend to be stationary—once they're set up, they stay there. Today, most balers are portable. Almost all modern balers use a hydraulic press. A motor powers a pump that pushes hydraulic fluid to drive cylinders. Using principles of force-multiplication, a hydraulic system can generate over 2,000 psi and impart more than 150 tons of force.

The press consists of several parts: bed where all the material is loaded; a plate rises to apply the compacting power; an engine, pump, valves, tubing and other parts of the hydraulic system, guideposts aligning the plate and making sure the compacting force is applied evenly.

While the above described baling structure may be suitable for baling paper, cardboard or other dry materials, it is generally not suitable for handling trash including moist garbage or other fluid containing refuse.

There are also available refuse compactors which are suited to the handling of liquid containing refuse and they generally solve the problem by utilizing a waterproof container into which the loose trash is compacted. It is to be noted; however, if one were to attempt to utilize a preformed carton in the baler apparatus, during the downward stroke of the compaction plate thereof, the container would be at least partially torn and crushed.

Most trash compactors compress trash in the compactor into a cube shape but when the trash is removed the trash tends to expand and unless contained in a bag or box the cube of compacted trash tends to expand and fall apart making the compacted trash hard to handle and move from the trash compactor to a waste container such as a dumpster or for shipping to a land fill.

It would be an advantage to be able to bale the compacted trash in the trash compactor before removing the compacted trash and transporting it to waste storage and thereafter to a landfill or other waste disposal facility.

A need, therefore, exists for a waste baling machine providing:

an easy way to wrap string around a bale of compacted trash in the cavity of a trash compactor without removing the bale from the trash compactor cavity before it is baled;

quick and easy baling of trash in a trash compactor;

easy access to the bale of trash and safety features to isolate the trash during compaction;

easy access entryways to the trash bales;

effortless handling of large access doors to the trash bales;

a way to pull baling string around the back and under a bale of compacted trash without undue resistance of the string between the compacted trash and the cavity walls or base; and a storage area for the baling string and an easy way to use the string stored in the storage area.

SUMMARY OF THE INVENTION

In some embodiments, a compactor may include one or more of the following features: (a) a base, a first side panel, and a second side panel, (b) a first door for access to the compactor to place trash into the compactor for compacting, (c) a second door for access to the compactor to remove compacted trash (d) at least one door operably coupled to a counterbalance weight to provide easy movement of the at least one door to move along a track, (e) at least one continuous channel beginning in an upper portion of a back wall and traversing to a front of the base, the channel having a curved portion transitioning from the back wall to the bottom wall, (f) a machine compartment for housing string used to tie around a bale of trash in the compactor, the string surrounding the compacted trash and tied off to secure the bale of compacted trash prior to removal from the cavity of the compactor, (g) a top panel operably coupled to the first and second side panel, (h) a third door for access to the machine compartment, and (i) a second counterbalance operably coupled to the second door to provide easy movement of the second door along a second track.

In some embodiments, a refuse compactor may include one or more of the following features: (a) a base, a first side panel, and a second side panel, (b) a machine compartment, a receiving compartment, and a compaction compartment located within the compactor, (c) a first door operably coupled to a first counterbalance to allow the first door to slidably move along a first track, (d) a second door operably coupled to a second counterbalance to allow the second door to slidably move along a second track, (e) a platen operably coupled to a hydraulic pump located in the machine compartment for compacting refuse in the compaction compartment, (f) a top panel, (g) a third door providing access to the machine compartment, (h) a control box located on at least one side panel, and (i) a power control switch and operational switch located adjacent to the control box.

In some embodiments, a method of compacting refuse may include or more of the following steps: (a) inputting the refuse into a receiving compartment of a compactor where the refuse comes to rest in a compacting compartment of the compactor, (b) placing a first door over an access to the receiving compartment and a second door over an access to the compacting compartment, (c) initiating compaction of the refuse, (d) powering on the compactor, and (e) removing a refuse bale after compaction.

DESCRIPTION OF THE PREFERRED EMBODIMENT

Figure 1:
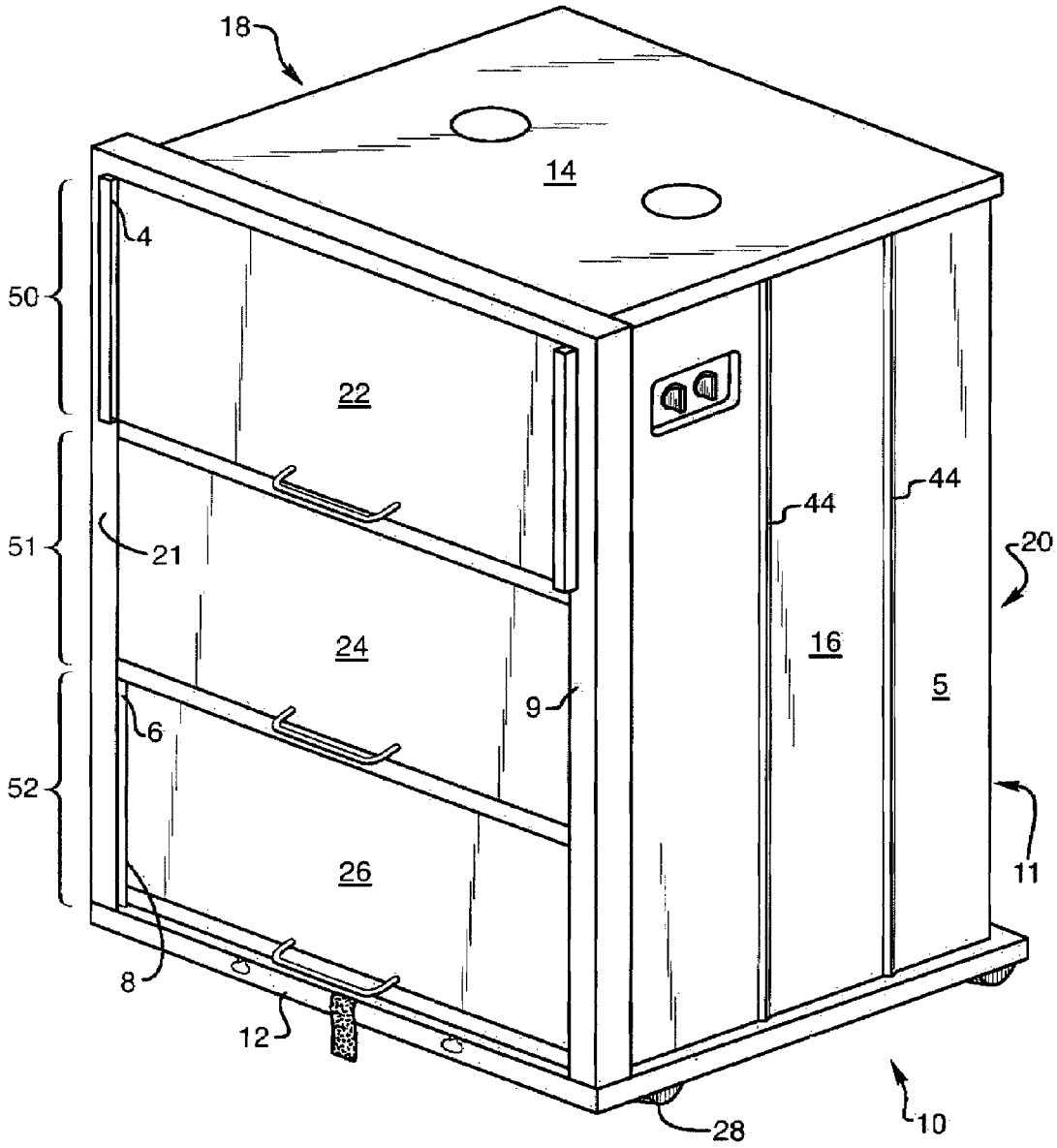
FIG. 1 is a perspective view of an embodiment of the present invention.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings. While embodiments of the present invention are described with reference to a trash compactor it is fully contemplated embodiments of the present invention could be used for recyclables and reusable material's without departing from the spirit of the invention.

Referring first to FIG. 1, the trash compactor cabinet of the present invention is indicated generally by numeral 10. It includes a base plate 12, a top panel 14, frame 11 having a right side panel 16, a left side panel 18, and a rear wall 20. These panels are joined to form a generally rectangular parallelepiped of a predetermined length, width, and height Secured in tracks 4, 6, and 8 on the front edge of the front portion 21 are first 22, second 24, and third 26 access doors. The cabinet 10 may be mounted on castors as at 28 to facilitate the repositioning of the compactor 10.

Frame 11 can be made of two panels 16 and 18 of sheet metal which are shaped to provide a front portion 9, a side wall 5, and half the back wall 20 of frame 11. The construction of frame 11 is discussed in more detail in a co-pending patent application titled "Trash Compactor Cabinet", Ser. No. 11/949,855, filed on Dec. 4, 2007, the contents of which are herein incorporated by reference in its entirety. Front portion 9 of frame 11 has a small front facing surface for attaching doors 22, 24, and 26 for access to compactor 10. Back 20 and sides 5 has a V-shaped indentation 44 for allowing a passage between back 20 and shelving in compactor 10 and to give back 20 added strength. Back 20 also has a V-shaped overlap portion 37 which connects two pieces 16 and 18 of frame 11 and adds strength to compactor 10. Shelves can be attached to the walls in frame 11 which provide strength for frame 11 and support the mechanisms for compacting trash.

Compactor 10 can be made from pieces of sheet metal which are shaped to provide side panels 16 and 18 and rear 20. The front of compactor 10 has doors 22, 24, and 26 for access to compactor 10. Rear panel 20 has a V-shaped indentation for allowing a passage between the back wall and a shelf in compactor 10 and to give rear panel 20 added strength. Shelves and supports are attached to panels 16, 18, and 20 in compactor 10 which provide strength for compactor 10 and support the mechanisms for compacting trash. A base 12 and top panel 14 attached to the sheet metal pieces complete the construction of compactor 10. Panels 16 and 18 of compactor 10 are bent into the desired shape and are lightweight, inexpensive, and strong. V-Shaped indentations 44 add strength to rear panel 20 and allow a passageway between rear panel 20 and shelves (FIG. 3) inside trash compactor 10.

Figure 2:
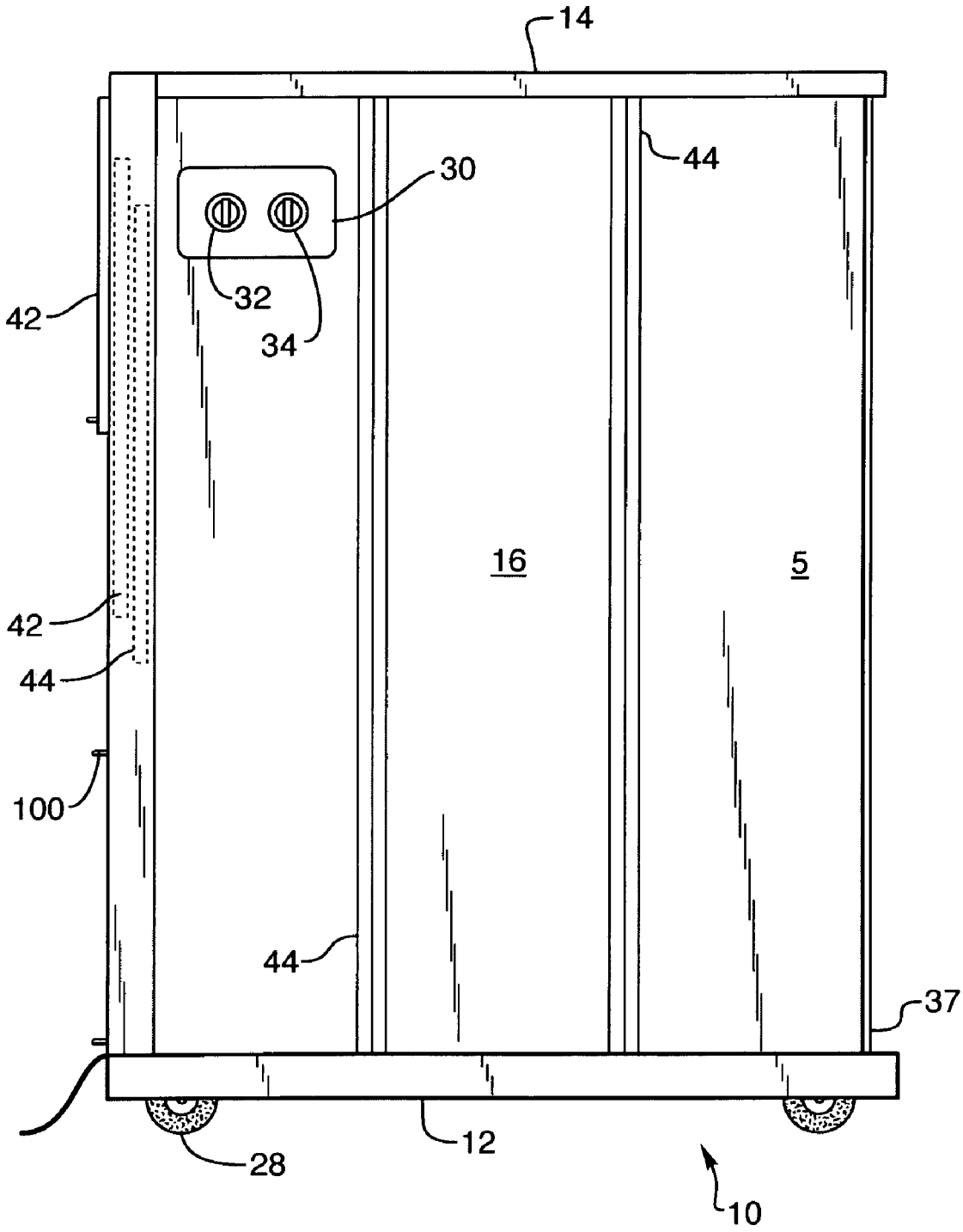
FIG. 2 is a side view of an embodiment of the present invention.

With reference to FIG. 2, a side view of an embodiment of the present invention is shown. Mounted upon right side panel 16 is control box 30 with power control switch 32 and operational switch 34. Power control switch 32 activates or provides power to compactor 10 when an operator turns power control switch 32 from an "off" position to an "on" position. Operational switch 34 is used by an operator when it is desired to compact materials within compactor 10. The operator would turn operation switch 34 to a "compact" position to begin the compaction process. Also shown are counterbalances 40 and 42 discussed in more detail below.

Figure 3:
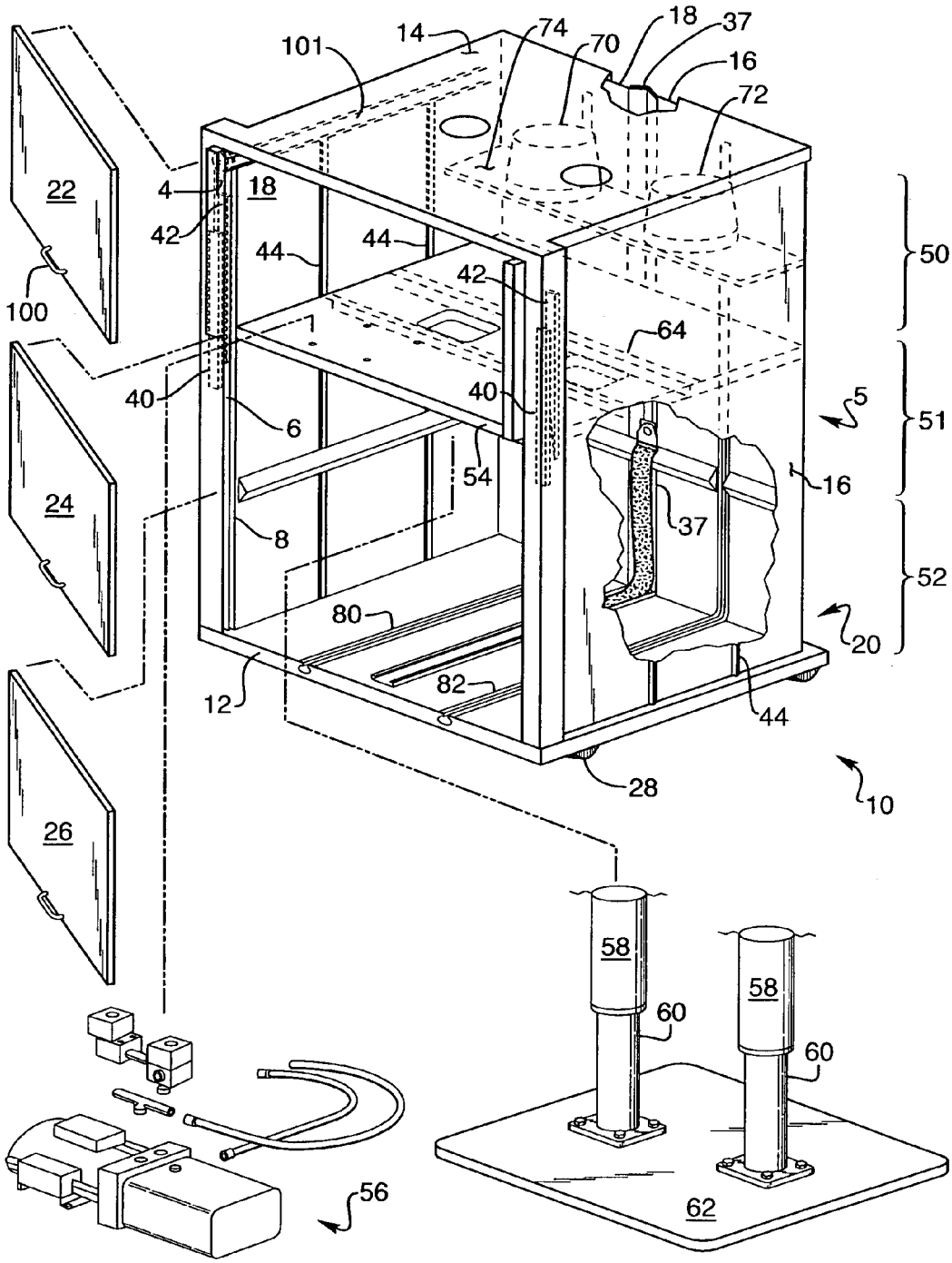
FIG. 3 is a exploded view of an embodiment of the present invention.

Next, with reference to FIG. 3, it can be seen the interior of compactor 10 is effectively and functionally divided into three compartments or volumes. Specifically, the so-called machine compartment is identified by numeral 50, trash receiving compartment 51, and the trash compacting compartment by numeral 52. Dividing the machine compartment 50 from the trash compacting compartment 52 is a mounting plate 54 on which is mounted a hydraulic pump 56, a hydraulic cylinder 58, and the various electrical and hydraulic controls for the system. Piston 60 of the hydraulic cylinder 58 passes through an opening in the mounting plate 54 and affixed to the lower end thereof is a compaction plate or platen 62. With reference to FIG. 3, there is further shown a cross arm 64 which is also disposed in the machinery containing compartment 50 and which is affixed at opposed ends thereof to panels 16 and 18. The uppermost end of the cylinder 58 abuts and is fastened to a further horizontal structural member comprising the cabinet framework and the lower end thereof is suitably clamped to the cross arm 64. Thus, when actuated, the piston 60 moves outwardly from its cylinder 58 causing the platen 62 to move downward for a predetermined distance into compaction compartment 52.

In operation, after trash compactor 10 compresses the trash in compaction compartment 52 a cube of trash in compartment 52 could be baled so it remains in a cube and is easier to handle for transporting, storing, and disposal. In order to bale the cube of compacted trash it is necessary to surround the bale with a bailing material such as twine, rope, string, a webbing material, tape, or wire. A spool of string 70 provides string to bale the left side of the compacted trash in compartment 52 and a spool 72 provides string for the right side of the compacted trash in compartment 52. String from spool 70 runs behind spool shelf 74 and then travels in channel 80 behind mounting plate 54 and stays in channel 80 behind platen 62 to enter compartment 52. Similarly string from spool 72 runs behind spool shelf 74 and then travels in channel 82 behind mounting plate 54 and stays in channel 82 to go behind platen 62 to enter compartment 52. The strings can then be placed on the back side and the bottom side of the compacted cube of trash without removing the cube of trash from the cavity.

Figure 4:
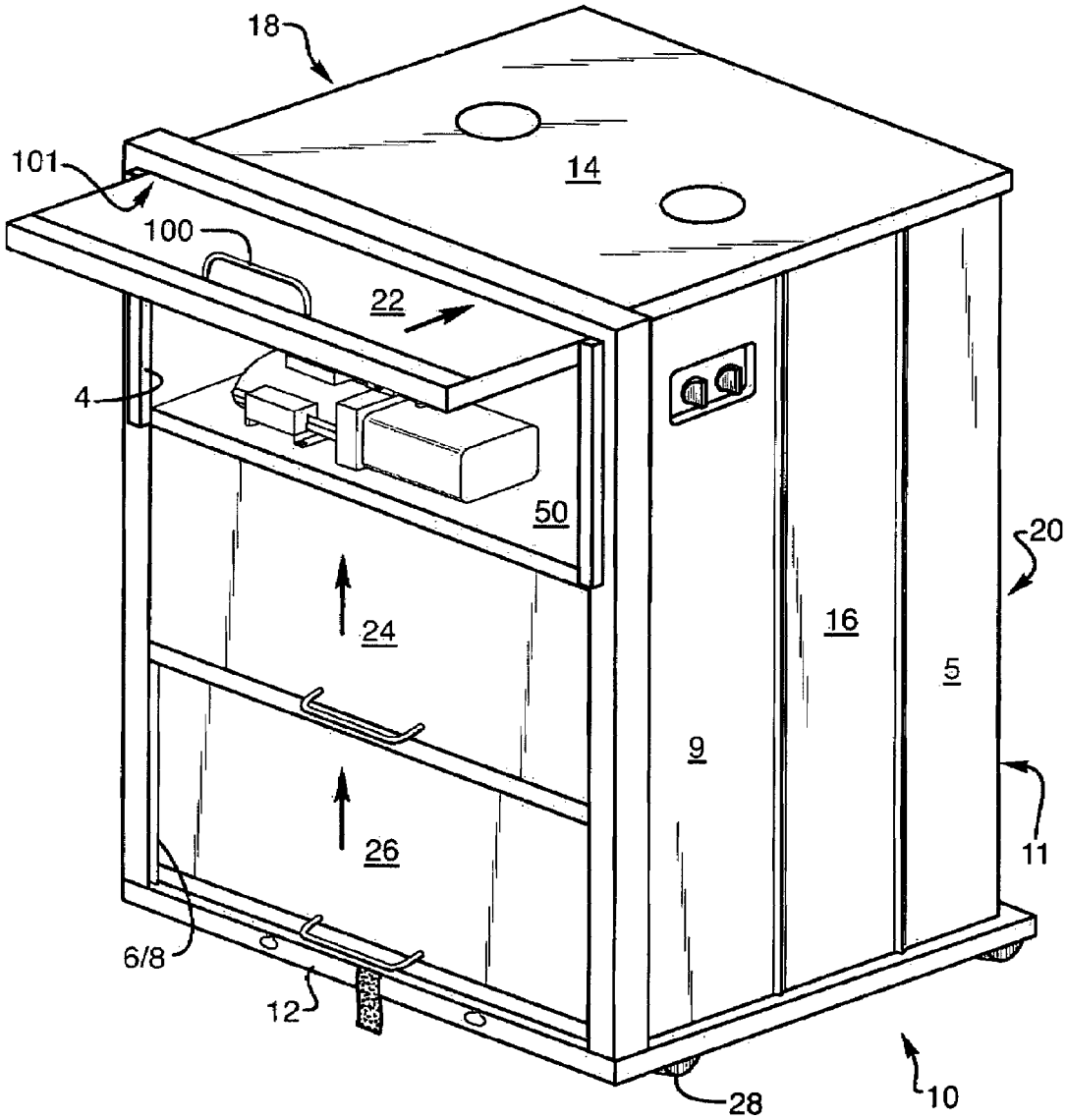
FIG. 4 is an isometric view of a front of a compactor in an embodiment of the present invention.

With reference to FIG. 4, an isometric view of a front of a compactor in an embodiment of the present invention is shown. Door 22 is most commonly shut to isolate machine compartment 50 from the operator. Should the operator need access to machine compartment 50, perhaps to replace a spool of string 70, the operator would simply grasp handle 100 and pull door 22 towards the operator lifting on handle 100 and sliding door 22 along roller tracks 101 along a top portion of machine compartment 50. With door 22 open, the operator could perform duties or maintenance within machine compartment 50 as necessary. When the operator was finished, he/she could grasp handle 100 pull door 22 towards them, lowering handle 100 so door 22 once again covers machine compartment 50.

Trash compacting compartment 52 is adjacent to trash receiving compartment 51. Trash receiving compartment 51 provides a space for an operator to input trash and recyclables into compactor 10. There are several ways an operator could input trash and/or recyclables into compactor 10. An operator could slide door 24 upward along track 6 placing door 24 in an up position. Now the operator could input the trash directly into trash receiving compartment 51 allowing the materials to fall to compacting compartment 52. Door 24 slides easily along track 6. Very little effort is needed by the operator as door 24 is counterbalanced by weight 42. Door 24 could also be lowered toward base 12 thus again exposing trash receiving compartment 51. In this operation, door 24 would move in a downward direction as counterbalance 42 moved man upward direction. Whether door 24 is in a fully up or down state, the operator is able to input trash into trash receiving compartment 51.

If necessary trash receiving compartment 51 and compaction compartment 52 can be fully exposed to an operator by sliding doors 24 and 26 along tracks 6 and 8 respectively upwards. Here once again, counterbalances 42 and 40 respectively allow the operator to apply minimal force to doors 24 and 26 to raise them. Doors 24 and 26, and counterbalances 42 and 40 can weigh approximately the same amount. Therefore, counterbalances 42 and 40 would not tend to fall due to gravity if doors 24 and 26 weighed less than counterbalances 42 and 40. This would also prevent doors 24 and 26 from falling due to gravity if left unattended if the weight of counterbalances 42 and 40 was less than the doors. By having the weight of doors 24 and 26 be approximately the same as the counterbalances 42 and 40 a balance can be obtained where doors 24 and 26 will remain when placed somewhere by the operator.

With door 26 in an upward position, an operator could have access to compaction compartment 52 to remove a bale of trash or recyclable material. The operator could also insert material to be compacted this way as well.

Figure 5:
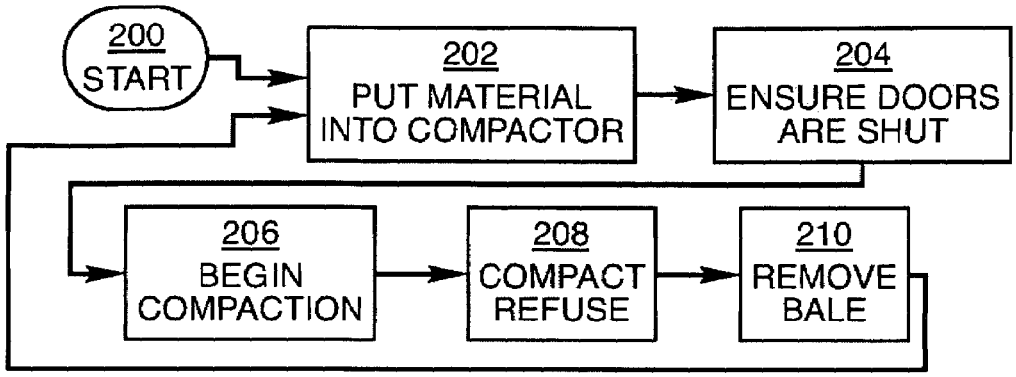
FIG. 5 is a flow process diagram showing an operation in an embodiment of the present invention.

With reference to FIG. 5, a flow process diagram showing an operation in an embodiment of the present invention is shown. In process operation 200 then, trash can be inserted into the compaction compartment 52 or receiving compartment 51 at state 202. The operator can also ensure doors 22 is closed and doors 24 and 26 are covering receiving compartment 51 and compaction compartment 52 respectively at state 204. When a sufficient level of trash is deposited into compaction compartment 52, the operator turns switch 34 to actuate motor 56 causing the hydraulic piston 60 to move out from its cylinder 58 at state 206. In doing so, compaction plate 62 traverses receiving compartment 51 and partially enters compaction compartment 52 at state 208. The loose refuse is thereby compacted and, again, piston 60 and platen 62 can be raised to permit additional trash to be deposited. When the level of compacted trash reaches a predetermined level or weight, the operator can open the access door 26 and remove the trash bale at state 210. More material can now be inserted into receiving compartment 51 and the process can begin all over again at state 202.

Thus, embodiments of the WASTE BALING MACHINE are disclosed. One skilled in the art will appreciate the present teachings can be practiced with embodiments other than those disclosed. The disclosed embodiments are presented for purposes of illustration and not limitation, and the present teachings are limited only by the following claims.

What is claimed is:

1. A refuse compactor, comprising:

a base, a first side panel, and a second side panel, each of the side panels is shaped to provide a front portion, a sidewall, and half of a back wall of the compactor, the side panels having a V-shaped overlap portion where the first side panel and the second side panel are connected together;

a machine compartment, a refuse receiving compartment, and a refuse compaction compartment located within the compactor;

a first door providing access to the refuse receiving compartment, the first door connected to first counterbalance weights positioned on opposing sides of the first door to allow the first door to vertically slide along a first track;

a second door providing access to the refuse compaction compartment, the second door connected to second counterbalance weights positioned on opposing sides of the second door to allow the second door to vertically slide along a second track;

a third door providing access to the machine compartment, the third door being in a horizontal sliding relationship with roller tracks located along a top portion of the machine compartment;

a plurality of continuous channels formed beginning in an upper portion of the back wall and traversing to a front of the base for guiding strapping material; and a platen operably coupled to a hydraulic pump located in the machine compartment for compacting refuse in the compaction compartment.

2. The compactor of claim 1, further comprising a top panel.

3. The compactor of claim 1, further comprising a control box located on at least one of the side panels.

4. The compactor of claim 3, further comprising a power control switch and operational switch located adjacent to the control box.

5. The compactor of claim 1, wherein the first and second doors are approximately the same weight as the first and second counterbalance weights respectively.

* * * * *